US005282762A

United States Patent [19]

Cerreto

[11] Patent Number: 5,282,762

[45] Date of Patent: Feb. 1, 1994

[54] PROPELLER DRIVE AND STEERING MECHANISM FOR SMALL CRAFT

[76] Inventor: John Cerreto, 55 Jones St., Wrentham, Mass. 02903

[21] Appl. No.: 742,307

[22] Filed: Aug. 8, 1991

[51] Int. Cl.[5] ..... B63H 16/20

[52] U.S. Cl. ..... 440/30; 440/31

[58] Field of Search ..... 440/26, 27, 28, 29, 440/30, 31, 32, 55, 56, 21, 22, 23, 24, 25; 114/165

[56] References Cited

U.S. PATENT DOCUMENTS

| | | | |
|---|---|---|---|
| 1,695,304 | 12/1928 | Turner | 440/30 |
| 1,826,507 | 10/1931 | Crosby | 440/30 |
| 2,172,401 | 9/1939 | Nelson | 440/30 |
| 2,484,720 | 10/1949 | Montalbano | 440/32 |
| 2,612,859 | 10/1952 | Billman et al. | 440/31 |
| 2,703,065 | 3/1955 | Gresham . | |
| 2,775,950 | 1/1957 | Dearmond | 440/30 |
| 2,940,415 | 6/1960 | Schwarzer | 440/31 |
| 3,010,421 | 11/1961 | Perkins . | |
| 3,038,433 | 6/1962 | DeLong | 114/165 |
| 3,211,125 | 10/1965 | Benjamin . | |
| 3,244,136 | 4/1966 | Yarbrough . | |
| 3,257,987 | 6/1966 | Liard . | |
| 4,324,551 | 4/1982 | Gurries . | |
| 4,427,392 | 1/1984 | Schneider | 440/30 |
| 4,891,024 | 1/1990 | Benjamin . | |

FOREIGN PATENT DOCUMENTS

| | | | |
|---|---|---|---|
| 45635 | 6/1888 | Fed. Rep. of Germany | 440/29 |

*Primary Examiner*—F. J. Bartuska
*Assistant Examiner*—Thomas J. Brahan
*Attorney, Agent, or Firm*—Pandiscio & Pandiscio

[57] ABSTRACT

A portable propeller drive and steering mechanism for small craft in which a frame is provided with an adjustable seat and a pedal driven chain drive connected to a geared transmission, and which has a chain drive output powering a horizontally arranged jack shaft. The jack shaft is provided with a universal gearbox whose output in turn powers a propeller. A steering handle located adjacent the seat is provided with steering linkage connected to a propeller drive shaft housing which carries the propeller at one end and is rotatably mounted within the gearbox at its other end. Operation of the linkage causes rotation of the propeller drive shaft housing. Raising and lowering of the handle will cause motion between a pair of gears in the gearbox and rotation of the propeller drive shaft housing around the axis of the jack shaft to vertically raise and lower the propeller.

20 Claims, 8 Drawing Sheets

PROPELLER DRIVE AND STEERING MECHANISM FOR SMALL CRAFT

FIELD OF THE INVENTION

This invention relates to a boat propelling and steering means, and is more specifically concerned with providing a portable assembly to enable the propelling and steering of various small craft which can be readily installed in different boats.

BACKGROUND OF THE INVENTION

Various propeller-driven devices have been devised which can be attached to or installed in a small craft and which enable the user to propel the craft and at the same time to steer it. Some of these devices are propelled by a hand-driven crank while others are propelled by a bicycle-like foot pedal assembly.

Such a user-propelled craft is often used for fishing, where it is desirable to be able to keep at least one hand free at all times to attend to the fishing gear. It is also desirable to be able to troll and propel the boat in very shallow or weed-clogged water while retaining the maximum maneuverability and still engage in fishing. To accomplish such a result the propeller drive apparatus must be capable of being raised and lowered at will.

Steering of such craft is usually accomplished by mounting the propeller horizontally on a vertical shaft assembly which includes a vertically rotatable housing which enables pivoting of the propeller drive about a vertical axis so that the propeller can be pointed in the direction of desired thrust. Such a device is shown, for example, in U.S. Pat. No. 4,324,551 issued to Gurries on Apr. 13, 1982. In the Gurries device there is shown a bow-mounted hand-cranked cable-driven propeller drive. Being cable driven, it is believed that the crank can be turned in only one direction, since the cable will unwind, bind or break if the crank is turned in the opposite direction with a load at the other end of the cable drive. Steering of the craft is accomplished by a foot pedal-actuated steering cable which is wrapped around the upper portion of a propeller drive housing. The drive housing is enabled to rotate about a vertical axis. Further, in the Gurries device the propeller drive housing may be raised about a horizontal axis by actuating both steering foot pedals simultaneously and at the same time releasing a retaining pin on a catch bar. To lower the propeller drive such catch bar must be released by pulling on an attached string while again depressing both pedals simultaneously to allow the user to lower the propeller drive by gravity. Such a device is believed to be very awkward when a boat carrying it is attempted to be used for fishing purposes. Both hands and feet are occupied while propelling and raising and lowering the propeller, so that attention to the fishing gear cannot take place at such time. In addition, propeller cannot be simultaneously steered while it is being raised and lowered. Finally, when trying to lower the propeller drive a hand must be released from the hand crank mechanism to release the catch bar.

The ability to actuate a propeller drive by means of hand or foot pedals is shown in U.S. Pat. No. 3,010,421 issued to Perkins on Nov. 28, 1961. The Perkins propeller drive is adapted to be mounted on the stern or transom of a rowboat and cannot be raised or lowered while in operation.

Other foot-operated propeller-driven boat propulsion systems are shown in U.S. Pat. Nos. 2,703,065 issued to Gresham on Mar. 1, 1955; 3,211,125 issued to Yarbrough on Oct. 12, 1965; 4,891,024 issued to Benjamin on Jan. 2, 1990; and 4,427,392 issued to Schneider on Jan. 24, 1984.

The Gresham device is bolted to a boat and in order to raise the propeller drive a retaining hinge pin must be physically removed. Powered drive to the propeller in Gresham cannot take place when it is raised or lowered, and powered drive can only occur while the propeller drive is locked vertically, since rotation of Gresham's propeller drive shaft can only occur when a drive belt is fully extended and wrapped around drive sheaves.

The Yarbrough device also requires the physical removal of a drive pin to enable the lifting of the propeller out of the water. Steering cannot occur while the propeller is being raised or lowered in the water since a steering cable is used which will go slack when the pulley it is wrapped around is tilted along with the propeller drive shaft.

In the Benjamin device pivoting of the propeller drive shaft out of the water requires physically releasing a clamp, and steering is accomplished by means of a swivelled seat.

The Schneider device also requires that a hook be physically released to allow tilting upwards of the propeller driver shaft, and the actual tilting requires bodily grasping and moving the propeller drive assembly. In addition, in the Schneider device the operator faces rearwardly, thus necessitating continuous bodily turning movement to ascertain the direction of forward progress. Such an arrangement is believed to be inherently unsafe if there is only one occupant of the craft.

Still other boat drive and steering mechanisms are disclosed in U.S. Pat. Nos. 3,257,987 issued to Liard on Jun. 28, 1966; and 3,244,136 issued to Yarbrough on Apr. 5, 1966.

SUMMARY OF THE INVENTION

The present invention provides a steerable propeller drive system for a small boat in which maximum flexiblity of forward motion is attainable while still being enabled to propel the craft through shallow waters. All operations of the boat can be attained without requiring the use of both hands so that an operator is free to engage in fishing if desired while simultaneously propelling, steering and raising and lowering the propeller.

The propelling assembly is readily portable from craft to craft and includes a free-standing frame, a pedal-driven chain drive connected to a geared transmission, and a chain drive from the output of the geared transmission to a jack shaft. The jack shaft is the input to a universal gear box whose output powers the propeller through a drive shaft, which is contained within a drive shaft housing. Steering is accomplished by rotating the drive shaft housing, which is affixed to the propeller drive and which can rotate relative to the frame, by movement of a steering handle. Lifting and lowering of the propeller drive is manually accomplished by manipulating the steering handle.

It is therefore an object of the invention to provide a propeller drive for a small craft which permits simultaneous lifting and lowering of the propeller in the water while driving the propeller.

A further object of the invention is to provide a propeller drive which enables steering by rotation of the propeller drive shaft housing while still permitting simultaneous lifting and lowering of the propeller in the water.

BRIEF DESCRIPTION OF THE DRAWINGS

The above and other features and advantages of the present invention will become more readily apparent from a reading of the description following hereinafter and from an examination of the drawings, in which.

DETAILED DESCRIPTION OF THE INVENTION

Figure 1:
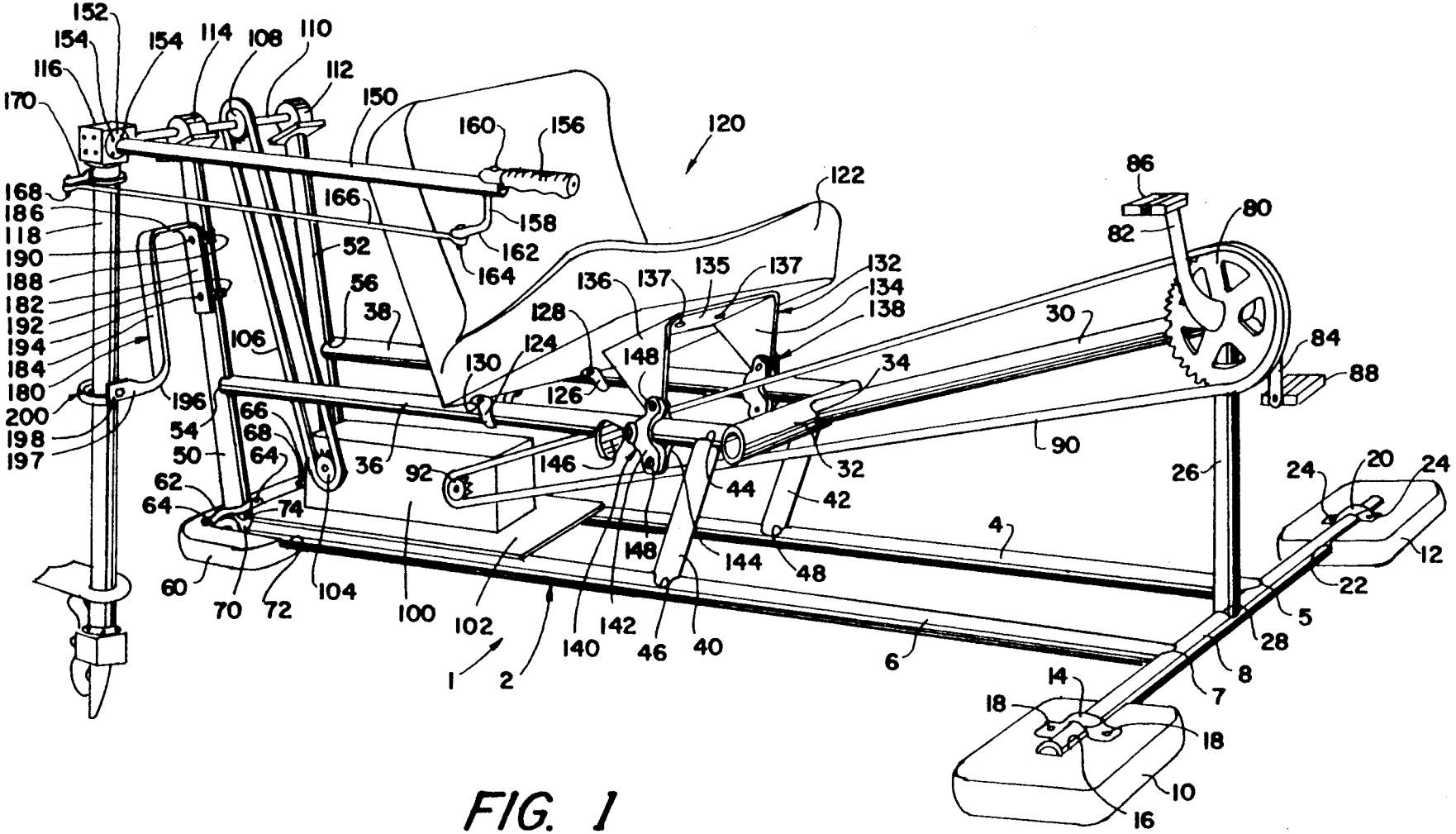
FIG. 1 is a perspective view of a preferred embodiment of the portable propeller drive assembly of the invention for use in a canoe.

As viewed in FIG. 1 a portable drive and steering unit 1 for propelling a small craft is provided which is constructed upon a frame 2. This frame is most economically constructed from a series of tubular members. Thus, there is a left base member 4 and a right base member 6 which are joined at the front by a front base member 8. This joinder of base member 8 to base members 4 and 6 is accomplished by welded joints 5 and 7, respectively. The front base member 8 rests upon pad members. More specifically, a right pad member 10 and a left pad member 12 support the front base member 8.

The right pad member 10 is mounted to the front base member 8 by means of a right front clamp bracket 14. The bracket 14 is assembled to pad 10 by means of a pair of fasteners 18, 18. The right end of base member 8 lies within a groove 16 in pad 10 so that the clamping of base member 8 to pad 10 will not enable it to be moved longitudinally with respect thereto. Similarly, the left pad member 12 is mounted to the front base member 8 by means of a left front clamp bracket 20. The bracket 20 is assembled to pad 12 by means of a pair of fasteners 24, 24. The left end of base member 8 lies within a groove 22 in pad 12 so that the clamping of base member 8 to pad 12 will not enable it to be moved longitudinally with respect thereto.

A front post 26 is mounted to the center of front base member 8 by means of the welded joint 28. A cross member 30 is similarly mounted to the top of the front post 26, at which point the front sprocket 80 is rotatably assembled. The other end of the frame cross member 30 is assembled to a seat front frame member 32 by means of the welded joint 34. The front frame member 32 forms a seat support frame when assembled to the right and left seat frame members 36 and 38, respectively. This seat frame is supported at a desired position above the base members 4 and 6 by means of a right front seat frame support member 40 which is welded at 44 to the right seat frame member 36 and is welded at 46 to the right base member 6. Similarly, the left front seat frame support member 42 is welded at 48 to the left base member 4 and is also welded at its top to the left seat frame member 38. The rear of the seat frame is supported by respective welded joints 54 and 56 to right rear post 50 and left rear post 52.

The rear posts 50 and 52 are joined at their bottom by the rear base frame member 70, as by welded joints such as 74. The rear of the frame 2 is supported upon a rear support pad 60. The assembled rear posts 50, 52 and rear base frame member 70 are received into a recessed area 72 in the rear support pad 60. To secure this assembly a right rear clamp bracket 62 secures the right rear post 50 to the pad 60 by means of fasteners 64, 64; and similarly a left rear clamp bracket 66 secures the left rear post 52 to the pad 60 by means of fasteners 68.

As indicated above, a sprocket 80 is rotatably mounted at the joinder of frame members 26 and 30. This sprocket is provided with right and left sprocket arms 82 and 84, respectively. A right pedal 86 is rotatably mounted on the sprocket arm 82, and a left pedal 88 is rotatably mounted on the sprocket arm 84, in a manner well known in the art. A front chain 90 is fitted over the sprocket 80 and passes through the seat frame and under the seat 122 to be fitted around an input sprocket 92 to a transmission 100. The transmission may be a series of spur gears which can give any desired ratio between the input and output sprockets 92 and 104, respectively. The transmission is mounted upon a platform 102 which is appropriately fastened to the frame 2 at the base members 4 and 6.

The output sprocket 104 of the transmission 100 drives a rear chain 106 which is fitted around a propeller drive sprocket 108. The sprocket in turn is affixed to the propeller cross-drive shaft 110 so as to rotate it. The shaft 110 passes through two pillow-block bearing supports 112 and 114 which are respectively mounted to the left and right rear posts 52 and 50. At the end of shaft 110 is mounted a universal gearbox 116, which is described in more detail hereafter in connection with the description of FIG. 3. A vertical propeller drive shaft housing 118 is rotatably mounted within, and depends from, gearbox 116, as is also apparent from an examination of FIG. 3.

Still looking now at FIG. 1, seat assembly 120 comprises the seat 122 which is mounted so that it is tilted as shown so as to provide the most comfortable position for the sportsman user as is possible. The rear end of the seat is mounted to the seat frame members 38 and 36 by means of seat mounting brackets 126 and 124, respectively. The right seat mounting bracket 124 passes around the right seat frame member 36 and is fastened to the bottom of the seat 122 by means of fasteners 130. Similarly, the left seat mounting bracket 126 passes around the left seat frame member 38 and is fastened to the bottom of the seat 122 by means of fasteners 128. The front of the seat is maintained in elevated position as shown by means of a seat mounting bracket 132. This bracket consists of a left depending arm 134 and a right depending arm 136. The arms are joined by a cross-over member 135, which is fastened to the underside of seat 122 by means of fasteners 137. Arm 134 is mounted on seat frame member 38 by means of a left seat clamping assembly 138. Similarly, the arm 136 is mounted on seat frame member 36 by means of a right seat clamping assembly 140. The assemblies 140 and 138 are identical and only one need be described in detail. To that end, assembly 140 comprises a right half 142 and a left half 144 of a clamping bracket which are held together by a pair of fasteners 148, 148. When so assembled, the clamping assemblies 138 and 140 have a sliding fit with their respective frame members 38 and 36. A clamping screw 146 located on the side of assembly 140 (a counterpart clamping screw—not shown—is provided on the side of assembly 138) enables fixing of the position of seat 122, since the brackets 124 and 126 allow for sliding motion between the seat 122 and the seat frame.

Figure 2:
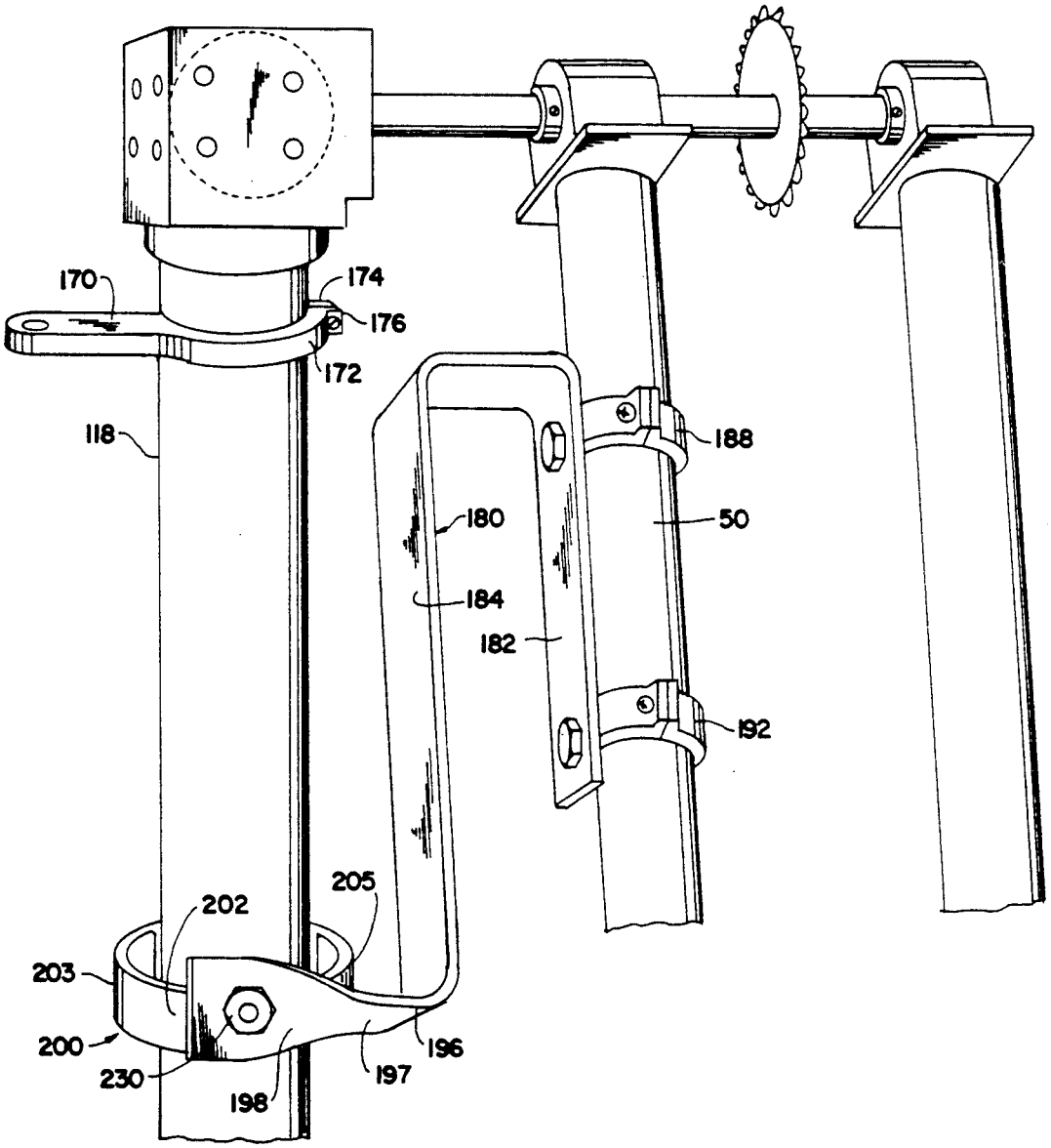
FIG. 2 is a perspective view of selected portions of the propeller drive assembly.

The craft is steered by rotating the drive propeller about a vertical axis. To enable such action a steering arm 150 is provided with a flanged sleeve 152 at one end which is fixedly mounted to the gearbox 116 by a series of fasteners 154. At the other end of the steering arm 150 is mounted a steering handle 156. The mounting arrangement consists of a vertical link 158 which passes through arm 150 and which can rotate with respect thereto. The top end of the link 158 also passes through the handle 156 and is affixed thereto by means of the headed end 160 which may be braised or welded thereto. Link 158 has a horizontal arm 162 extending therefrom which is joined to a horizontal link 166 by means of a pivot pin 164. The other end of the link 166 is joined to a steering bracket 170 by means of a pivot pin 168. As seen in FIG. 2, the steering bracket 170 comprises arms 172 and 174 which are fastened at their outer ends by a fastener 176 so that the bracket 170 is fixedly mounted to vertical propeller drive shaft housing 118, whereby movement of bracket 170 will cause corresponding movement of drive shaft housing 118.

Still referring to FIG. 1, the propeller drive shaft housing 118 is positioned outboard of the canoe (the starboard side being shown in FIG. 1) by means of an outboard mounting bracket 180. The bracket 180 is a rigid member which is formed generally in a U-shape to pass over the side of the canoe. This U-shape is provided by an inner leg 182 which is joined to an outer leg 184 by means of a connecting arm 186. The mounting bracket 180 is fastened at its inner leg 182 to the right rear post 50 by means of an upper clamp 188 and a lower clamp 192 which surround post 50 and which are affixed by the fasteners 190 and 194, respectively. The outer leg 184 of bracket 180 is extended outwardly at its lower end into a horizontal arm 196, which by means of a transition section 197, is formed into a vertically positioned plate 198, to which is affixed the spring latch assembly 200.

Figure 2A:
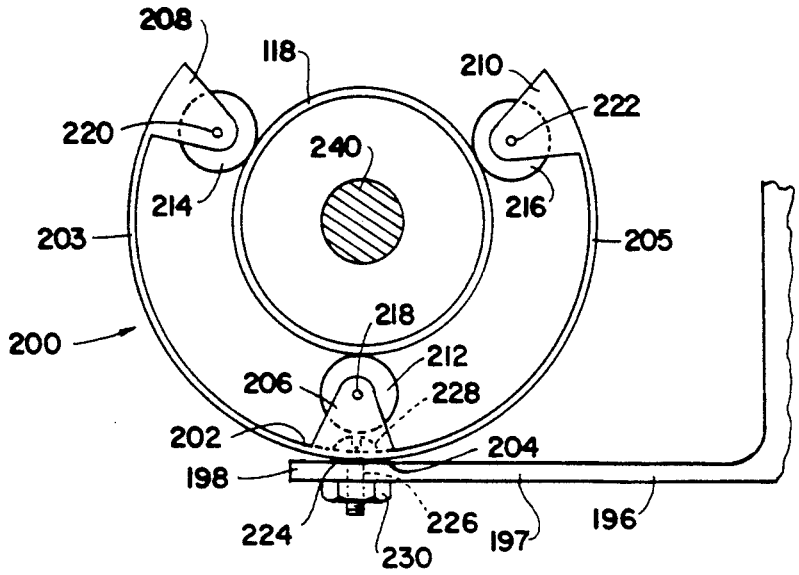
FIGS. 2A and 2B are plan views, partially in cross-section, of a latching mechanism for the propeller drive shaft housing of the embodiment of FIG. 1.
Figure 2B:
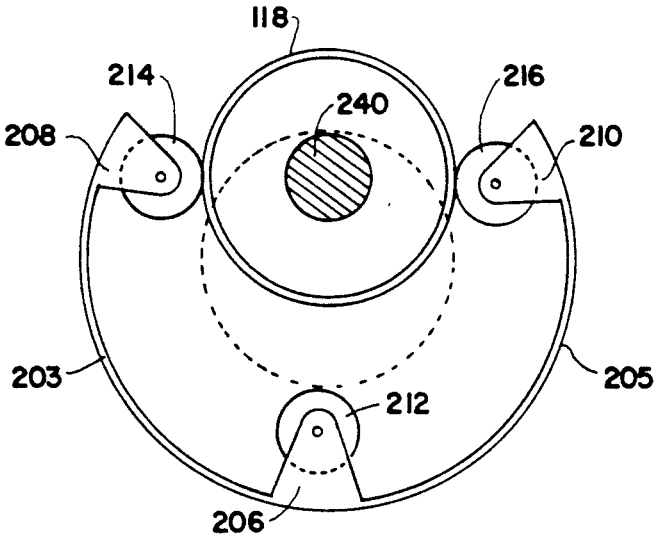

The springed latch assembly 200 is shown in greater detail in FIGS. 2, 2A and 2B. The latch assembly comprises a central section 202 and springed clamping arms 203 and 205 extended outwardly, one from each side of the central section to enclasp the propeller drive shaft housing 118. The central section 202 has an upwardly extending mounting plate 204 which has the hole 224 through it. A hole 226 is provided in vertical plate 198 of arm 196 to be aligned with hole 224 so as to enable a threaded bolt 228 to pass therethrough to allow a nut 230 to be placed thereon for securing the latch assembly 200 to the mounting bracket 180. The material of the latch assembly 200 may be a spring steel. Inwardly extending mounting arms 206, 208 and 210 are provided for the sections 202, 203 and 205, respectively, of the assembly 200. A series of rollers 212, 214 and 216 are mounted on respective arms 206, 208 and 210 by means of the mounting pins 218, 220 and 222. In this manner a springed latch assembly is provided which readily allows the housing 118, which encompasses the propeller drive shaft 240 (see FIGS. 2A and 2B), to be retained in a vertical locked position and, because of its springed nature, readily releases the housing 118 to enable repositioning of the shaft 240 at angles to the vertical.

Figure 3:
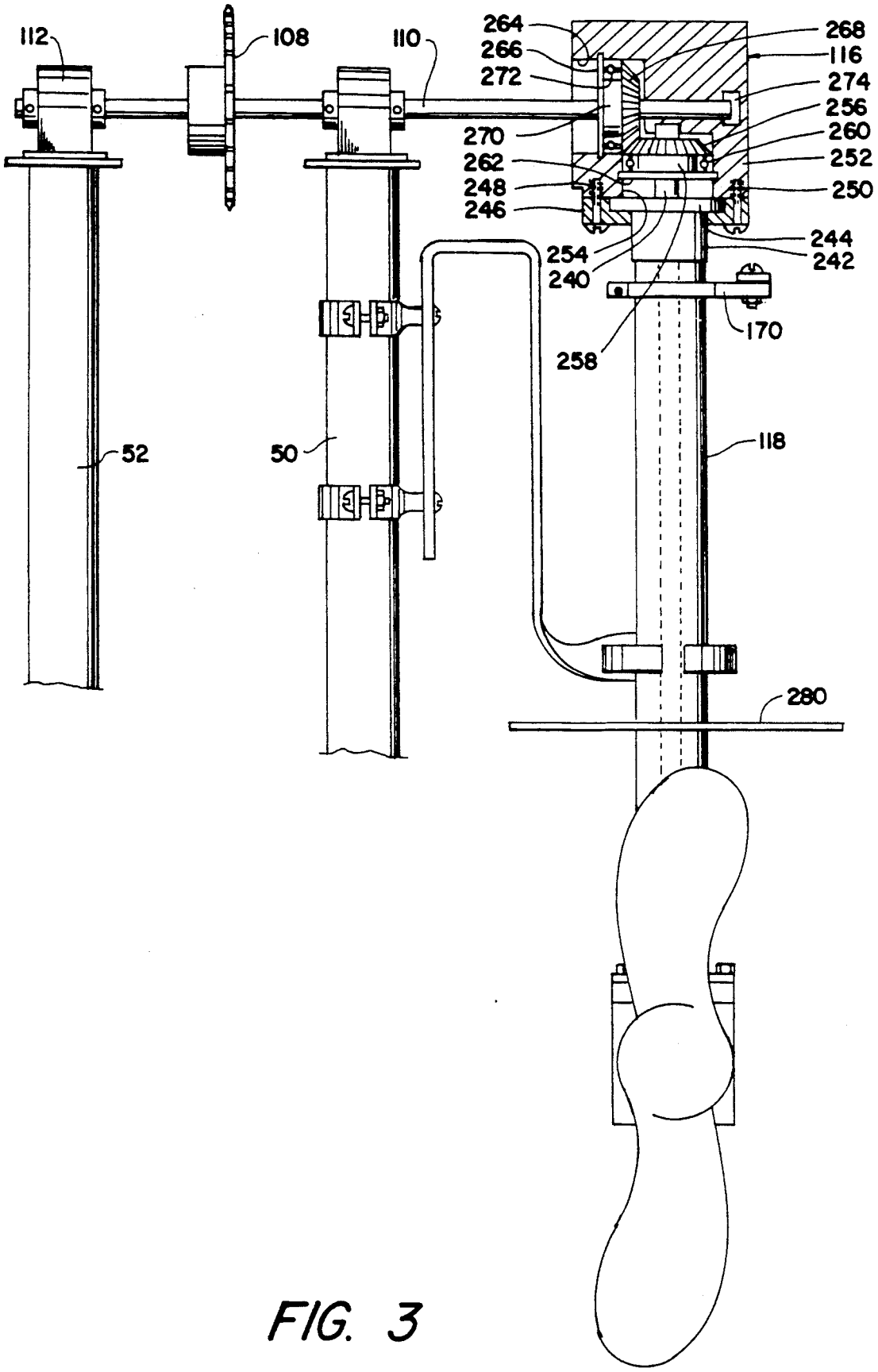
FIG. 3 is a rear view, partially in cross-section, of the portable propeller drive assembly of the invention depicting the arrangement of the transmission.

The nature of the universal gear box 116 is shown more clearly in FIG. 3. Propeller drive shaft housing 118 is provided with a sleeve at its upper end consisting of a hub 242 carrying an integral flange 244. This sleeve is welded or otherwise fastened to housing 118 so as to be rotatable with it. The flange is retained within a collar 246. This collar is fastened to a gear box housing 252 by means of a plurality of screws 250 which are assembled into threaded holes 248 in the gear box housing. The clearances are such that the flange 244 is free to rotate within the space delineated by the inside surface of the collar 246 and the lower surface of the gear box housing. Thus, steering can be accomplished by rotation of the steering bracket 170. The lower end of the gearbox 116 is provided with a vertically directed bore 254 which enables the shaft 240 to be received therewithin.

Mounted on the end of the propeller drive shaft, and affixed thereto as by set screws or other well known means, is a driven gear 256. This gear is shown as being a bevel gear which has a hub 258. A bearing 260 is fitted on the hub 258 in a well known manner to permit rotation of the gear 256. A snap ring 262 within the bore 254 serves to retain the bearing 260 in place.

The gearbox 116 is also provided with a horizontal bore 264 to receive shaft 110. The end of the shaft 110 is received within a bearing 274 located within the gearbox 116. A driving bevel gear 268 is mounted on shaft 110 and is provided with a hub 270. The gear 268 is retained on the shaft 110 by means of a set screw or the like carried by hub 270 and a snap ring 266. Gear 268 is permitted to rotate within the gearbox 116 by the bearing 272 which is fitted within the horizontal bore 264 in the gearbox. Gears 256 and 268 engage one another. At the lower end of the drive shaft housing 118 is located a cavitation plate 280 which cooperates with the propeller assembly in a well known manner.

Figure 4:
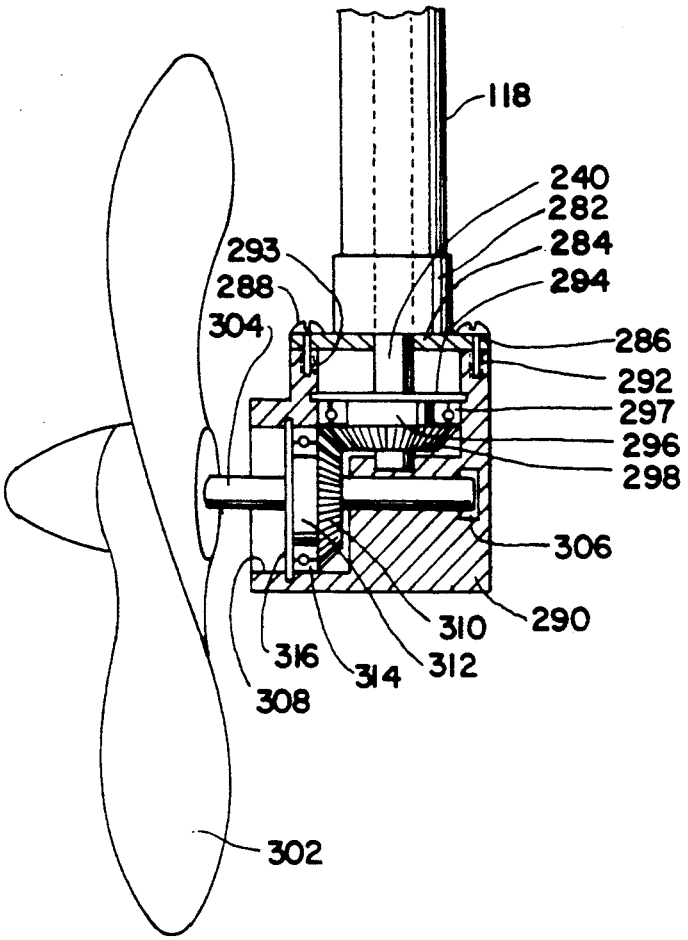
FIG. 4 is a side view, partially in cross-section, of the propeller mounting and drive of the assembly shown in FIGS. 1-3.

The nature of the propeller assembly is shown in more detail in FIG. 4. The propeller drive shaft housing 118 is provided with a sleeve at its lower end which consists of a hub 282 and a flange 284. The hub 282 is welded or otherwise affixed to the housing 118. The flange 284 is affixed to a lower gear box housing 290 by means of a series of screws 288 which pass through holes 286 in flange 284 and are fastened into threaded holes 292 in gear box housing 290. Thus, the gear box housing 290 will be caused to rotate when the housing 118 is rotated to reposition the propeller 302 in response to actuation of the steering linkage.

The housing 290 is provided with a vertical bore 293 to receive the propeller drive shaft 240. A driving gear 298 having a hub 296 is affixed to shaft 240 at its lower end by means of a set screw or the like. This gear is accommodated within the vertical bore 293 and is enabled to rotate with respect to the housing 290 by means of the bearing 297. A snap ring 294 fitted within the bore 293 is employed to retain the bearing 297 in position.

A horizontal bore 308 is also provided in the housing 290 to receive the propeller shaft 304. The propeller 302 is mounted on the external end of the shaft 304 to rotate therewith, and the other end of the shaft is inserted into an end bearing 306. A driven gear 310 is fixedly mounted on shaft 304 by means of set screws or the like passing through the hub 312 of the gear 310. A bearing 314 mounted on the hub is retained in place by the snap ring 316. Gears 298 and 310 engage one another.

In view of the foregoing construction, it will be seen that when pedals 86 and 88 are engaged to cause rotation of sprocket 80, this rotational movement will be translated via chain 90, gearbox 100, chain 106, shaft 110, shaft 240 and shaft 304 so as to cause corresponding movement of propeller 302. The gearing within the gearbox 116 is hereinafter referred to as a second transmission. Steering of the boat is accomplished by manipulating steering handle 156 about its pivot on steering arm 150, whereby the pivotal motion of handle 156 will be translated via linkages 158, 162, 166 and 170 so as to cause corresponding movement of drive shaft housing 118, and hence propeller 302. At the same time that propeller 302 is being powered and steered in the foregoing manner, it may also have its vertical position adjusted by pressing down or lifting up on steering handle 156, which will cause propeller 302 to raise or lower correspondingly.

Figure 5:
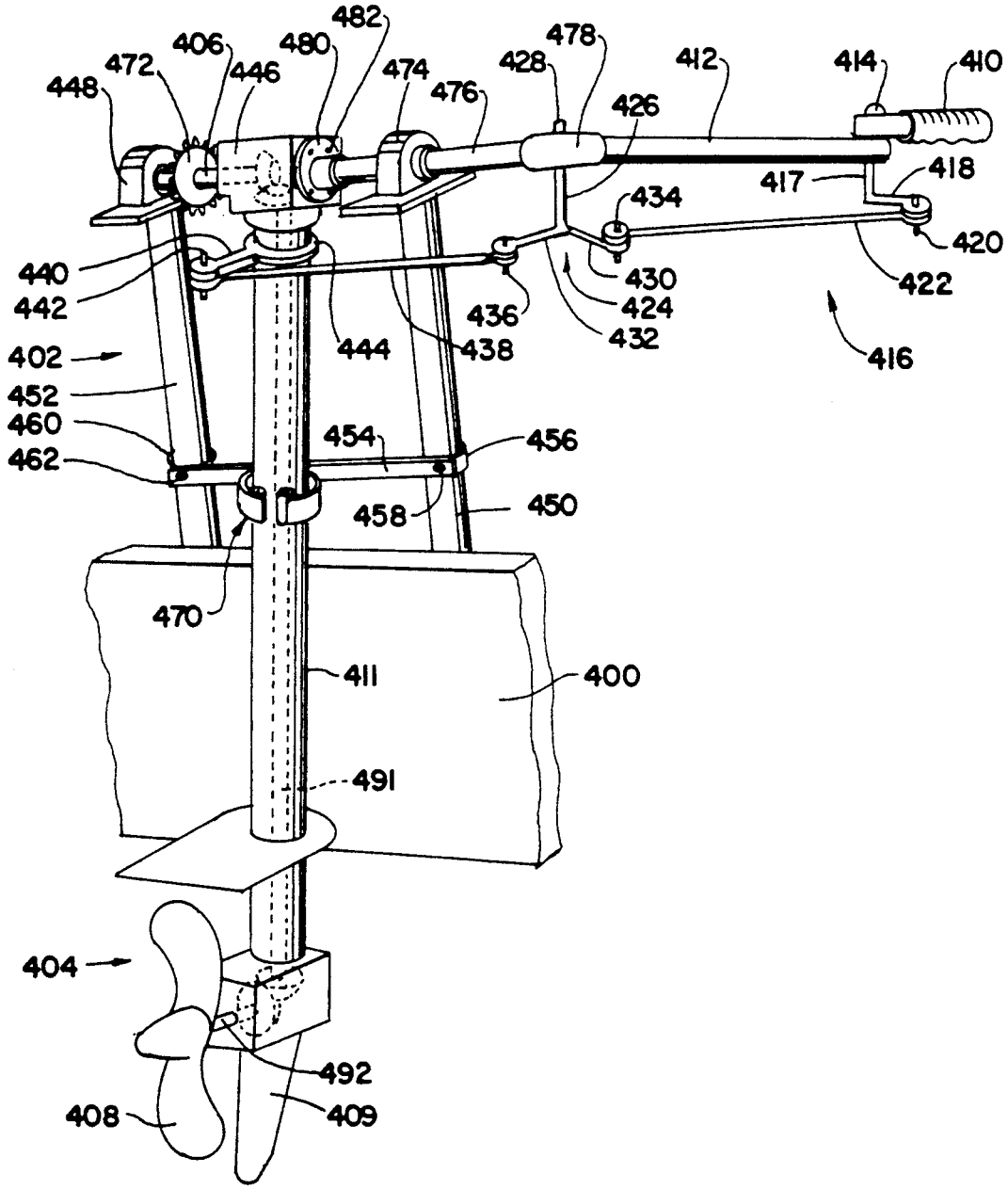
FIG. 5 is a partial perspective view of a second embodiment of the portable propeller drive assembly of the invention for use in a rowboat.

The propeller drive and steering mechanism is shown in FIGS. 1–4 as being adapted for use in a canoe, but it may also be adapted for use in a rowboat. As shown in FIG. 5 a flat bottomed boat 400 may accommodate a modified portable drive and steering unit 402, only the modified portion of which is shown. The propeller drive assembly 404 is now mounted astern and outboard of the boat. The steering linkage is different, in that it must now cooperate with this relocated propeller drive assembly and a foreshortened cross-drive shaft 406 for the propeller 408.

Steering is also accomplished by means of rotating the driving propeller 408 and rudder 409 (which is affixed to the propeller drive housing as shown in FIG. 5) about a vertical axis by means of the steering linkage 416. This linkage comprises a first steering arm 412 which is provided with a steering handle 410 at one end and a second steering arm 476 which is joined to the first steering arm by means of an elbow connector 478. Fixedly fitted on the other end of the second steering arm 476 is a sleeved flange 480 which is fastened to a universal gearbox 446 by means of a series of fasteners 482. The gearbox 446 is substantially identical to the gearbox 116 of the species of FIGS. 1–4 and need not be described further herein.

The elbow connector 478 is fixedly connected to steering arms 412 and 476 so that the steering arms move as a unit when rotated around a horizontal axis which coincides with the axis of the second steering arm 476 in order to raise and lower the propeller drive assembly 404.

The steering handle 410 is affixed to a head 414 of vertical link 417 which passes through the steering arm 412 and is rotatable with respect thereto about the axis of link 417. Link 417 has a horizontal arm 418 extending therefrom which is joined to a first horizontal link 422 by means of a pivot pin 420. The other end of the horizontal link 422 is joined to a horizontal arm 430 of a Y-shaped link 424 by means of a pivot pin 434. The upper end of the vertical arm 426 of the Y-link 424 passes through the elbow connector 478, and may be threaded at its upper end to cooperate with a nut 428 for fixedly assembling link 424 to elbow 478. A second horizontal arm 432 of the link 424 is joined to a second horizontal link 438 by means of the pivot pin 436. The other end of the horizontal link 438 is joined to a steering bracket 440 by means of the pivot pin 442. The steering bracket 440 enclasps the propeller shaft housing 411 by means of steering bracket arms 444, in the same manner as was done by the steering bracket 170 in the species shown in FIGS. 1–4. In this manner, rotation of the handle 410 will, through the linkage 416, effectuate rotation of the propeller shaft housing so as to reposition the propeller drive assembly 404 and redirect the direction of thrust of the propeller 408 so as to steer the rowboat.

The cross drive shaft 406 is foreshortened as indicated above and carries the driven sprocket 472, which functions similarly to the sprocket 108 of the species of FIGS. 1–4. One end of the shaft 406 is supported within the pillow block bearing 448 which is mounted on the left rear post 452, and the other end of shaft 406 is mounted in the gearbox 446. A much larger pillow block bearing 474 is mounted on the right rear post 450 and rotatably accommodates the second steering arm 476.

The two rear posts 450 and 452 are connected by a cross brace 454. This cross brace is assembled to the post 450 by means of clamp 456, which is held in place by fastener 458. The brace is also assembled to the post 452 by means of a clamp 460, which is held in place by fastener 462. The brace is provided in order to support a springed latch assembly 470, which is identical in all other respects to the similar latch assembly 200 shown in FIGS. 1, 2, 2A and 2B.

In view of the foregoing construction, it will be appreciated that when pedals 86 and 88 are engaged to cause rotation of sprocket 80, this rotational movement will be translated via chain 90, gearbox 100 and chain 106 (all not shown in FIG. 5), and via shaft 406, shaft 491 and shaft 492 so as to cause corresponding movement of propeller 408. Steering of the boat is accomplished by manipulating steering handle 410 about its pivot on steering arm 412, whereby the pivotal motion of handle 410 will be translated via linkages 417, 422, 424, 438 and 440 so as to cause corresponding movement of drive shaft housing 411, and hence propeller 408. At the same time that propeller 408 is being powered and steered in the foregoing manner, it may also have its vertical position adjusted by pressing down or lifting up on steering handle 410, which will cause propeller 408 to raise or lower correspondingly.

Figure 6:
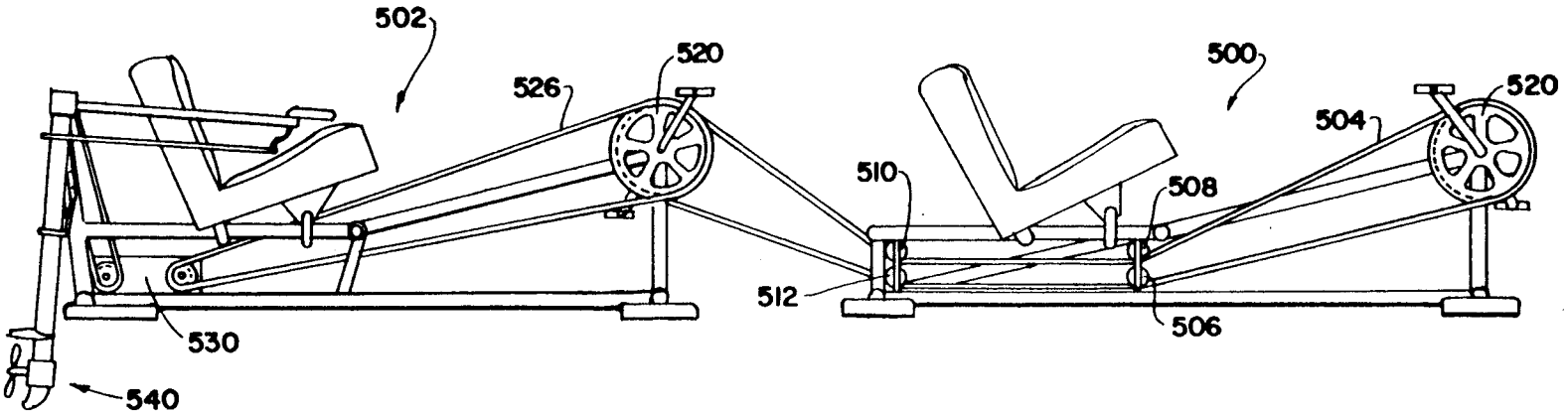
FIG. 6 is a side view of a tandem portable propeller drive assembly for use in a canoe.
Figure 7:
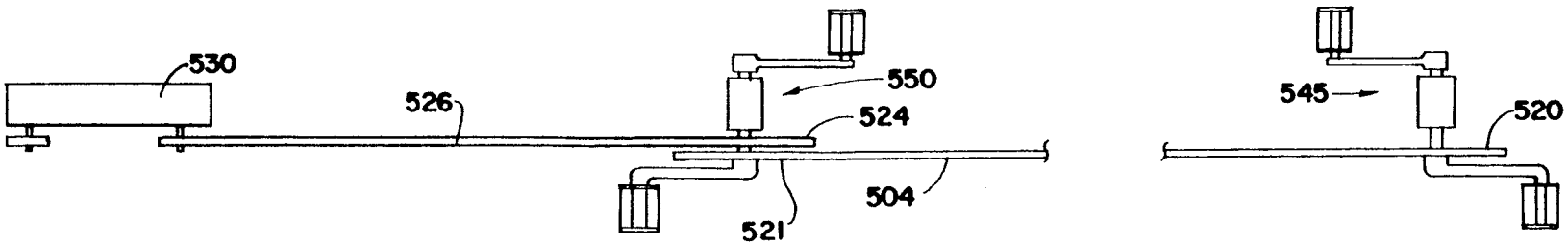
FIG. 7 is a top view of the tandem drive assembly of FIG. 6.

It may be desirable to employ the invention to accommodate two persons who desire to participate in the use of a small craft at the same time. A tandem arrangement can be provided by essentially using two units as shown in FIGS. 6 and 7. A front unit 500 is coupled to a rear unit 502 by means of a front chain 504. The two units are placed inside of a long canoe. The front unit 500 does not have a propeller or steering assembly, but is provided merely to allow a second person to power the canoe by means of a front pedal assembly 545 (see FIG. 7), at the same time that the first person powers the propeller assembly 540 by means of a rear pedal assembly 550, much in the same fashion as two users of a tandem bicycle. A front sprocket 520 allows the chain 504 to be powered by the second person. The front chain 504 passes under a front lower idler sprocket 506 and under a rear lower idler sprocket 512 before it is directed around the rear sprocket 521. The chain 504 is then directed around the rear upper idler sprocket 510 and the front upper idler sprocket 508 before it again is directed around the sprocket 520.

As shown in FIG. 7 the sprocket 521 is mounted on the same drive shaft as a front sprocket 524 for the rear chain 526. The rear chain 526 is then directed around the input sprocket for the transmission 530. In this manner, two persons, when pedaling in cadence, can power a canoe. It will be appreciated that rear unit 502 is identical to the portable drive and steering unit 1 shown in FIGS. 1-4, or is identical to the portable drive and steering unit 402 shown in FIG. 5, except for the provision of a furter sprocket 521 on the pedal assembly 550 so as to permit drive from front unit 500 to be combined with drive from rear unit 502.

Although what has been described are preferred embodiments, it is to be readily understood that various changes and modifications may be made without departing from the spirit and scope of the invention.

Figure 8:
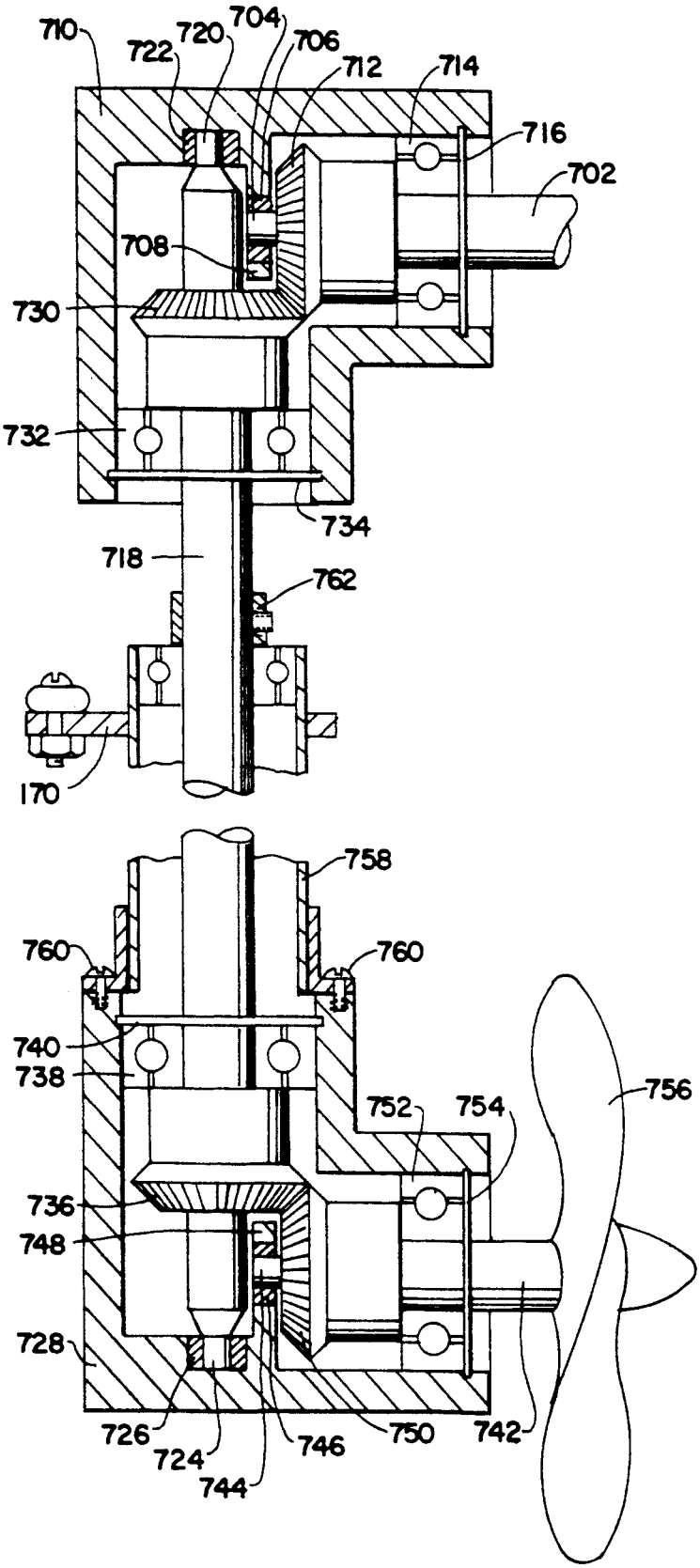
FIG. 8 is a side view, partially in cross-section of an alternative form of portable propeller drive assembly.

Thus, for example, FIG. 8 shows an alternative form of the propeller drive assembly. Looking now at FIG. 8, horizontal drive shaft 702 has its inner end 704 mounted in a bushing 706 set in a flange 708 of upper gearbox 710. A gear 712 is mounted on shaft 702 so as to rotate therewith. A bearing 714 supports shaft 702 and is kept in place by a snap ring 716.

Vertical shaft 718 has its top end 720 mounted in a bushing 722 set in gearbox 710, and its bottom end 724 mounted in a bushing 726 set in lower gearbox 728. A gear 730 is mounted on the upper end of shaft 718 so as to rotate therewith, and so as to engage gear 712 mounted on shaft 702. A bearing 732 supports shaft 718 and is kept in place by a snap ring 734. Another gear 736 is mounted on the lower end of shaft 718 so as to rotate therewith. A bearing 738 supports shaft 718 and is kept in place by a snap ring 740.

Propeller shaft 742 has its inner end 744 mounted in a bushing 746 set in a flange 748 of lower gearbox 728. A gear 750 is mounted on shaft 742 so as to rotate therewith, and so as to engage gear 736 mounted on vertical shaft 718. A bearing 752 supports shaft 742 and is kept in place by a snap ring 754. A propeller 756 is mounted on the outer end of shaft 742 so as to rotate therewith.

A vertical shaft housing 758 is mounted concentrically about vertical shaft 718. The lower end of housing 758 is secured to lower gearbox 728 by means of screws 760. A bearing 762 supports shaft 718 about the upper end of housing 758, whereby shaft 718 is free to rotate independently of housing 758. Steering bracket 170 is secured to the upper end of housing 758.

On account of the foregoing construction, it will be appreciated that when horizontal drive shaft 702 is rotated by the boat operator using the pedal apparatus previously described, the rotation of horizontal drive shaft 702 will be transferred to vertical shaft 718 and propeller shaft 742, whereby propeller 756 will be caused to rotate so as to drive the boat. At the same time, when the steering bracket 170 is moved about by the boat operator using the hand steering apparatus previously described, movement of bracket 170 will be transferred to vertical shaft housing 758 and lower gearbox 728, whereby propeller 756 will be moved so as to steer the boat.

What is claimed is:

1. An apparatus which can be operated to propel and steer a small craft without being affixed to such craft comprising, in combination:

a frame, having mounted thereon:

adjustable seat means;

a first transmission means having an input and an output means; and pedal propulsion means drivingly connected to said input means;

a propeller assembly including a rotatably mounted propeller, said propeller assembly being substantially laterally offset in relation to and outboard of said frame;

second transmission means drivingly connected to a first portion of said propeller assembly and arranged to be in connection with said output means;

steering means operably connected to a second portion of said propeller assembly and arranged to reposition said propeller about a vertical axis when desired, said steering means having no operative connection to said seat means; and means for rotating said propeller assembly bodily about a horizontal axis without disabling the driving relationship between said pedal propulsion means and said propeller, and without requiring an operator to discontinue an activity in which he is engaged, whereby a craft which is to be propelled may continue to be powered regardless of the depth of positioning of the propeller in the body of water in which the craft may be immersed.

2. The propelling and steering apparatus of claim 1 in which said frame includes members upon which said seat is slidably mounted, and means for releasably but fixedly positioning said seat on said frame members.

3. The propelling and steering apparatus of claim 1 wherein said propeller assembly includes a propeller drive shaft and a propeller drive shaft housing, said second transmission means includes a housing and at least one pair of mating gears located within said housing, one of said gears being arranged to drive said propeller drive shaft, said propeller drive shaft housing being rotatably mounted within said second transmission housing, and said steering means operating to rotate said propeller drive shaft housing to accomplish repositioning of said propeller about said horizontal axis.

4. The propelling and steering apparatus of claim 3 wherein the steering means includes a mechanical linkage mounted upon said propeller drive shaft housing and having an operating handle means positioned adjacent said seat means.

5. The propelling and steering apparatus of claim 3 wherein the means for rotating said propeller assembly about a horizontal axis comprises a rigid member affixed to said second transmission housing and extending towards said seat means, whereby when said rigid member is grasped and raised or lowered, said one gear will be caused to rotate on its mating gear and said propeller assembly will be rotated about said horizontal axis.

6. The propelling and steering apparatus of claim 5 wherein said steering means includes a mechanical linkage mounted upon said propeller drive shaft housing and having an operating handle means mounted on said rigid member and positioned adjacent said seat means.

7. The propelling and steering apparatus of claim 5 wherein said mating gear is mounted upon a horizontal shaft extending outwardly of said second transmission housing, and a sprocket mounted upon said horizontal shaft is arranged to be in driving connection with said output means of said first transmission.

8. The propelling and steering apparatus of claim 1 including means for releasably retaining said propeller assembly in vertical oriented position outboard of said frame.

9. The propelling and steering apparatus of claim 8 wherein said releasably retaining means comprises a springed latch assembly which partially encircles said first portion of said propeller assembly.

10. The propelling and steering apparatus of claim 1 wherein said propeller assembly is arranged to be substantially laterally offset to the starboard side of a craft into which said apparatus is placed, whereby the propeller will be immersed in the body of water into which the craft may be placed.

11. The propelling and steering apparatus of claim 1 wherein said propeller assembly is arranged to be substantially laterally offset to the stern of a craft into which said apparatus is placed, whereby the propeller will be immersed in the body of water into which the craft may be placed.

12. The propelling and steering apparatus of claim 1 including a second frame adapted to be mounted forward of said first mentioned frame, said second frame having mounted thereon:

a second adjustable seat means; and a second pedal propulsion means adapted to be drivingly connected to said first mentioned pedal propulsion means.

13. An apparatus which can be operated to propel and steer a small craft without being affixed to such craft comprising: in combination:

a frame, having mounted thereon:

adjustable seat means;

a first transmission means having an input and an output means; and pedal propulsion means drivingly connected to said input means;

a propeller assembly including a rotatably mounted propeller, a propeller drive shaft, and a propeller drive shaft housing, said propeller assembly being substantially laterally offset in relation to and outboard of said frame;

second transmission means including a housing and at least one pair of mating gears located within said housing, one of said gears being arranged to drive said propeller drive shaft, said second transmission means being arranged to be in connection with said output means;

means for rotating said propeller assembly bodily about a horizontal axis without disabling the driving relationship between said pedal propulsion means and said propeller, sand without requiring an operator to discontinue an activity in which he is engaged, whereby a craft which is to be propelled may continue to be powered regardless of the depth of positioning of the propeller in the body of water in which the craft may be immersed, said propeller drive shaft housing being rotatably mounted within said second transmission housing; and steering means operating to rotate said propeller drive shaft housing, to accomplish repositioning of said propeller, said steering means having no operative connection to said seat means.

14. The propelling and steering apparatus of claim 13 wherein the means for rotating said propeller assembly about a horizontal axis comprises a rigid member affixed to said second transmission housing and extending towards said seat means, whereby when said rigid member is grasped and raised or lowered, said one gear will be caused to rotate on its mating gear and said propeller assembly will be rotated about said horizontal axis.

15. The propelling and steering apparatus of claim 14 wherein said mating gear is mounted upon a horizontal shaft extending outwardly of said second transmission housing, and a sprocket mounted upon said horizontal shaft is arranged to be in driving connection with said output means of said first transmission means.

16. The propelling and steering apparatus of claim 13 including means for releasably retaining said propeller assembly in vertical oriented position outboard of said frame.

17. The propelling and steering apparatus of claim 16 wherein said releasably retaining means comprises a springed latch assembly which partially encircles said propeller drive shaft housing.

18. The propelling and steering apparatus of claim 13 wherein said propeller assembly is arranged to be substantially laterally offset to the starboard side of a craft into which said apparatus is placed, whereby the propeller will be immersed in the body of water into which the craft may be placed.

19. The propelling and steering apparatus of claim 13 wherein said propeller assembly is arranged to be substantially laterally offset to the stern of a craft into which said apparatus is placed, whereby the propeller will be immersed in the body of water into which the craft may be placed.

20. The propelling and steering apparatus of claim 13 including a second frame adapted to be mounted forward of said first mentioned frame, said second frame having mounted thereon:

a second adjustable seat means; and a second pedal propulsion means adapted to be drivingly connected to said first mentioned pedal propulsion means.

* * * * *